US012780479B2

(12) United States Patent
Steele, Jr. et al.

(10) Patent No.: US 12,780,479 B2
(45) Date of Patent: Nov. 3, 2026

(54) AUTOMATED DECANTING APPARATUS, A SYSTEM INCLUDING THE APPARATUS, AND A METHOD OF AUTOMATIC DECANTING

(71) Applicant: Cornerstone Automation Systems, LLC, Frisco, TX (US)

(72) Inventors: Richard K. Steele, Jr., Plano, TX (US); Jeffrey Grindstaff, Collinsville, TX (US)

(73) Assignee: Cornerstone Automation Systems, LLC, Frisco, TX (US)

( * ) Notice: Subject to any disclaimer, the term of this patent is extended or adjusted under 35 U.S.C. 154(b) by 55 days.

(21) Appl. No.: 18/605,388

(22) Filed: Mar. 14, 2024

(65) Prior Publication Data

US 2024/0308714 A1 Sep. 19, 2024

Related U.S. Application Data

(60) Provisional application No. 63/490,334, filed on Mar. 15, 2023.

(51) Int. Cl.
*B65B 69/00* (2006.01)

(52) U.S. Cl.
CPC ..... *B65B 69/0033* (2013.01); *B65B 69/0025* (2013.01); *B65B 69/005* (2013.01)

(58) Field of Classification Search
CPC ..... B65B 69/0033; B65B 69/0025; B65B 69/005
See application file for complete search history.

(56) References Cited

U.S. PATENT DOCUMENTS 3,922,778 A * 12/1975 Aalpoel ..... B65B 69/0033 83/425.2
5,771,661 A * 6/1998 Martin ..... A24B 3/00 414/420
6,694,852 B1 * 2/2004 Ours ..... B65B 69/0033 414/412
7,694,614 B2 * 4/2010 Hilgendorf ..... B26D 7/2621 83/403.1

(Continued)

FOREIGN PATENT DOCUMENTS

CH 703288 A2 * 12/2011 ..... B65B 69/0033
CN 107878866 A * 4/2018 ..... B65B 69/0033

(Continued)

*Primary Examiner* — Eronica Martin
*Assistant Examiner* — Mobeen Ahmed

(57) ABSTRACT

The disclosure provides an automated process, apparatus and system for decanting containers. The automated decanting process can include receiving containers, cutting the containers, such as along a cut line that is proximate the top of the container, flipping the containers once cut, and separating products from the containers by moving the containers. Moving the containers for the separation or removal of the products from the containers can be a lifting motion, a sliding/pushing motion, or a combination thereof. In one example, a method of automatically decanting products includes: (1) cutting a container along a cut line proximate a top of the container, wherein the container includes product, (2) rotating the container, and (3) separating the product from the container by moving the container.

22 Claims, 14 Drawing Sheets

(56) References Cited

U.S. PATENT DOCUMENTS

| | | | | |
|---|---|---|---|---|
| 9,457,474 | B1 * | 10/2016 | Lisso | B26D 1/45 |
| 10,329,042 | B2 * | 6/2019 | Nammoto | B65B 5/06 |
| 11,186,399 | B2 * | 11/2021 | Dugat | B65B 69/0033 |
| 11,806,825 | B2 * | 11/2023 | Edwards | B25J 9/1633 |
| 11,827,405 | B2 * | 11/2023 | Griffith | B65B 69/00 |
| 11,836,672 | B2 * | 12/2023 | Lert, Jr. | G06Q 10/0833 |
| 12,115,590 | B2 * | 10/2024 | Edwards | B23D 59/001 |
| 2003/0155452 | A1 * | 8/2003 | Herget | B65B 69/0083 239/650 |
| 2004/0194428 | A1 * | 10/2004 | Close | B65B 69/0025 53/381.2 |
| 2004/0250670 | A1 * | 12/2004 | Porter | B65B 69/0025 83/401 |
| 2007/0125209 | A1 * | 6/2007 | Hilgendorf | B26D 7/2621 83/72 |
| 2007/0162174 | A1 * | 7/2007 | Doke | B25J 9/0093 700/114 |
| 2007/0251858 | A1 * | 11/2007 | Martinez | B65D 77/02 206/703 |
| 2013/0125517 | A1 * | 5/2013 | Gomi | B65B 69/0033 53/381.1 |
| 2014/0190130 | A1 * | 7/2014 | Cramer | B65B 69/0033 53/381.1 |
| 2016/0016684 | A1 * | 1/2016 | Dugat | B23K 26/38 53/75 |
| 2017/0313514 | A1 * | 11/2017 | Lert, Jr. | B65G 1/0492 |
| 2020/0039746 | A1 * | 2/2020 | Lert, Jr. | B65B 21/00 |
| 2020/0047364 | A1 * | 2/2020 | Hawkins | B26D 7/0625 |
| 2020/0122870 | A1 * | 4/2020 | Wapinsky | B65B 43/52 |
| 2020/0270076 | A1 * | 8/2020 | Geyer | B65G 65/23 |
| 2020/0306973 | A1 * | 10/2020 | Edwards | B25J 9/0093 |
| 2021/0086936 | A1 * | 3/2021 | Nishigaito | B65B 69/0033 |
| 2021/0130025 | A1 * | 5/2021 | Schaafsma | B26D 1/01 |
| 2022/0063042 | A1 * | 3/2022 | Edwards | B25J 11/0055 |
| 2022/0111538 | A1 * | 4/2022 | Tsujimori | B25J 15/0071 |
| 2022/0161951 | A1 * | 5/2022 | Ghestem | B25J 11/0055 |
| 2022/0219857 | A1 * | 7/2022 | Tsujimori | B25J 11/0055 |
| 2022/0281685 | A1 * | 9/2022 | Lert, Jr. | B65G 1/06 |
| 2023/0075513 | A1 * | 3/2023 | Kim | B65B 69/00 |
| 2023/0286689 | A1 * | 9/2023 | Wierenga | B65B 69/0033 |
| 2023/0382588 | A1 * | 11/2023 | Hoffman | B65B 69/0033 |

FOREIGN PATENT DOCUMENTS

| | | | | |
|---|---|---|---|---|
| CN | 207712447 | U * | 8/2018 | B65B 69/00 |
| CN | 117533616 | A * | 2/2024 | B65B 69/0033 |
| EP | 1415920 | A1 * | 5/2004 | A24B 3/00 |
| EP | 2894017 | A1 * | 7/2015 | B26D 1/141 |
| JP | H1191746 | A * | 4/1999 | B65B 69/00 |
| JP | 2003081230 | A * | 3/2003 | B65B 69/00 |
| WO | WO-2019123241 | A1 * | 6/2019 | B65B 69/0033 |
| WO | WO-2024150788 | A1 * | 7/2024 | B65B 43/46 |

* cited by examiner

AUTOMATED DECANTING APPARATUS, A SYSTEM INCLUDING THE APPARATUS, AND A METHOD OF AUTOMATIC DECANTING

CROSS-REFERENCE TO RELATED APPLICATION

This application claims the benefit of U.S. Provisional Application Ser. No. 63/490,334, filed by Richard K. Steele, J R., et al. on Mar. 15, 2023, entitled "AN AUTOMATED DECANTING APPARATUS, A SYSTEM INCLUDING THE APPARATUS, AND A METHOD OF AUTOMATIC DECANTING," commonly assigned with this application and incorporated herein by reference in its entirety.

TECHNICAL FIELD

This application is directed to decanting products and, more specifically, to automatically decanting products.

BACKGROUND

Boxes, cartons, or other types of containers are used to safely package products for shipping. In warehouses or fulfillments centers products are often received in one type of container, removed, and then placed in other containers for storage. The storage containers can then be placed on racks for later retrieval of the products. The storage containers can be part of an automated storage and retrieval system (ASRS). Whether a traditional storage system or an ASRS, products may have to be removed from their shipping containers and placed in storage containers. Opening, unpacking, and transferring the products from an enclosed container, such as a shipping container, to another container for storage is a time consuming process. With the growth of online retail, the time required to unpack or decant products has become an even greater time consuming process as fulfillment centers receive and store products for filling multiple shipping orders on a daily basis. As such, an improved way to decant products would be advantageous.

SUMMARY

In one aspect, the disclosure provides an automated decanter. In one example, the automated decanter includes: (1) a cutting tool configured to cut a container along a cut line, wherein the container has a bottom, a top, and multiple side walls between the bottom and the top, and the cut line is proximate the top, (2) a flipping mechanism configured to flip the container upside down after the cut, and (3) a depositing device configured to, after the container is flipped upside down, separate one or more products within the container from the container.

In another aspect, the disclosure provides a product processing system. In one example, the product processing system includes: (1) an automated transport system, (2) an automated decanter that receives containers from the automated transport system and has (2A) a flipping mechanism configured to flip the containers, wherein the containers have at least one side that has been cut, and (2B) a depositing device configured to, after the containers are flipped, separate one or more products within the containers from the containers.

In yet another aspect, the disclosure provides a method of automatically decanting products. In one example, the method includes: (1) cutting a container along a cut line proximate a top of the container, wherein the container includes product, (2) rotating the container, and (3) separating the product from the container by moving the container.

BRIEF DESCRIPTION

The foregoing summary, preferred examples, and other aspects of the subject matter of the present disclosure will be best understood with reference to the detailed description of specific examples, which follows, when read in conjunction with the accompanying drawings, in which.

DETAILED DESCRIPTION

Figure 1:
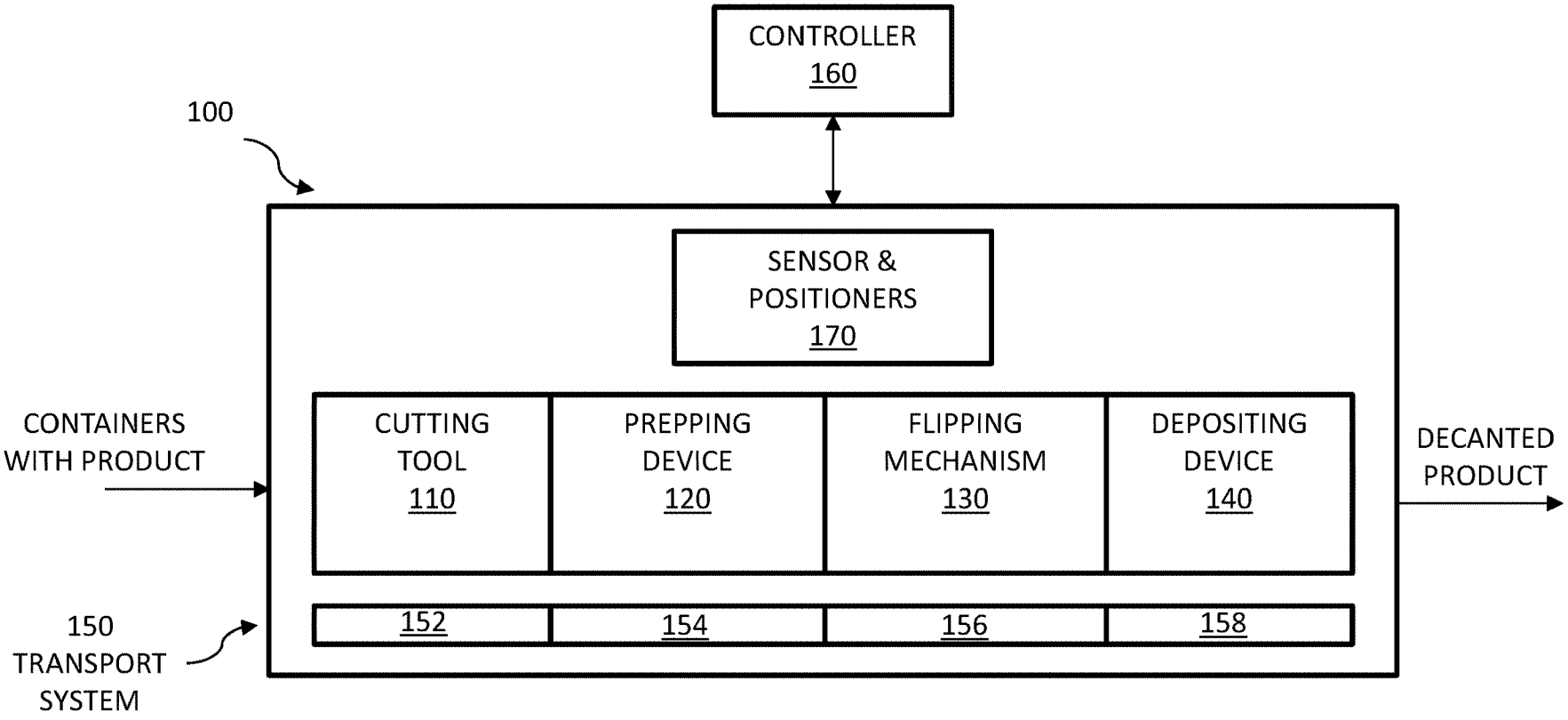
FIG. 1 illustrates a block diagram of an example of an automated decanting system constructed according to the principles of the disclosure.

The disclosure recognizes the benefit of automated decanting. Accordingly, the disclosure provides an automated process, apparatus and system for decanting containers. A container is an object that can hold one or more products and can be used to ship or transport the one or more products. A container can include multiples of the same product or even different products. Discussion herein may use a single product within a container as an example but the discussion is applicable to containers having more than one product and having different products.

The container can be made from a variety of durable materials, such as wood, metal, plastic, and non-durable, such as corrugated fiberboard, paperboard, and cardboard. A container has a three dimensional shape and typically a flat bottom that allows transporting on a conveyor, or other transport system, and stacking or nesting. A container can be, for example, a rectangular prism having flat, parallel, rectangular sides or side walls, a top, and a bottom. A container can have a separate lid or one or more flaps that are used to enclose the one or more products. A fastener such as an adhesive, glue, or tape can be used to secure the lid or flaps. A box is an example of a container and will be used in parts of the disclosure as a non-limiting example of a container The automated decanting process can include receiving containers, cutting the containers, such as along a cut line that is proximate the top of the container, flipping the containers once cut, and separating products from the containers by moving the containers. Moving the containers for the separation or removal of the products from the containers can be a lifting motion, a sliding/pushing motion, or a combination thereof. The automated decanting process can further include preparing the top of the containers for removal of the one or more products. The preparing, or prepping, can be after the cutting and before the flipping. For example, prepping can include releasing the top of the container after being cut, which allows depositing of the products after the container is flipped.

The bottoms of the containers sit or rest on a surface for the cutting and the prepping. After the flipping, the top of the containers sit or rest on a surface. The containers can be located on one or more stationary surfaces or on one or more moving surfaces that transport the containers through the different stages of the automated decanting process. The stationary surface can be a table or a floor. The moving surfaces can be a transport system and can be manually or automatically operated. The transport systems used for the different stages can be independently controlled but coordinated to move containers from one stage to another. For example, each of the different stages of the automated decanting process can be performed by one or more tools, mechanisms, or devices and one or more of the tools, mechanisms or devices can have an associated transport system that abuts to a transport system of another one of the tools, mechanisms, or devices. As such, a flipping device and a depositing device can be used to perform portions of the automated decanting process and a transport system associated with the flipping device can abut to a transport system proximate the depositing device. The transport systems can include actuatable rollers and the rollers can be self-automated. The transport systems can be conveyors and one or more of the conveyors disclosed herein can be cleated conveyors.

The one or more products are located within a volume or void defined by the side walls, top, and bottom of the containers. The decanted products are deposited on a surface when separated from the containers for additional processing. The decanted products can be deposited on a different surface for the additional processing that is at a different height than the first surface upon which the cutting, flipping, and preparing are performed. For example, the different or second surface can be lower than the first surface and the container can be moved over (e.g., slid or pushed to be above) the second surface for removing the product(s). Another container can be positioned on the second surface and receive the decanted product(s). The second surface can be another transport system. Depending on the surface, the decanted product(s) can be manually or automatically moved to a product processing station for additional processing as noted below.

The automated decanting process can further include discarding the containers after the removal of the product. The containers can be discarded on various surfaces including a transport system, the floor, or a trash bin. The discarded containers can be manually removed after discarding or automatically moved away, such as by an automated transport system.

The automated decanting process can be performed by an automated decanting system (or simply automated decanter), such as illustrated in FIG. 1. Automated decanter 100 of FIG. 1 includes a cutting tool 110, a container prepping device 120, a flipping mechanism 130, and a depositing device 140. The automated decanter 100 can further include a transport system 150, such as an automated transport system as noted above. The automated decanter 100 can also include at least one controller, represented by controller 160, which includes one or more processors that direct the operation of the automated decanter 100.

The automated decanter 100 can also include various types of sensors that can be used with the controller 160 to direct operation of the automated decanter 100. For example, lasers, cameras, scanners, etc. can be used to track movement of the containers on the transport system 150 through different stages of the decanting process and indicate completion of a stage and/or when a stage can be initiated. A combination of different sensors can be used with the controller 160. Stopping rails can also be used to position the containers within one or more of the various stages of decanting. The stopping rails can be a plate that pops up between the rollers of the transport system 150 when the containers are travelling along the transport system 150. The containers bump up against the stopping rail and the transport system 150 is stopped. The stopping rails can be lowered or raised by an actuator, such as a solenoid or hydraulic cylinder, driven by the controller 160. For example, the controller 160 can operate a stopping rail to stop a container for flipping by the flipping mechanism 130. The automated decanter 100 can also include other rails that are operated by the controller and used to position or move the containers on the transport system 150 to align the containers for processing by the cutting tool 110, prepping device 120, flipping mechanism 130, and/or depositing device 140. Sensors/positioners 170 in FIG. 1 represents the various sensors and positioning devices of the automated decanter 100.

The cutting tool 110 can be used to perform the cutting of the containers, which can be of different sizes. The cutting tool 100 can cut along a cut line according to a cutting pattern determined by the controller 160. The cut line can be along a tape line that corresponds to tape or another adhesive that is used to secure the top of the container. The top can be in multiple pieces, such as flaps, that are taped together to enclose the product(s) within the container. Cutting along the cut line can release the flaps or the top such that product can be removed from the container when the container is rotated upside down (top is rotated to the bottom and the bottom is rotated to the top such that gravity assists in releasing the product from the void of the container). The cut line can be along one or multiple side walls or seams between a side wall and the top. The cutting tool can be a robotic device, such as a robotic arm. The cutting tool 110 can be an intelligent box opening device (IBOD) available from Cornerstone Automation Systems, LLC of Frisco, Texas. The IBOD is described in U.S. Pat. Nos. 7,720,567 and 8,463,428, which are incorporated herein by reference. Other programmable cutting tools can also be used.

The container prepping device 120 prepares the container for decanting of the product. The container prepping device 120, for example, can be constructed to separate portions of the container along the cut line. For example, with a tape cut that releases the top of containers, the container prepping device 120 can be used to pop the flaps of the top. As such, the operation or even presence of the container prepping device 120 can depend on the type of cut performed by the cutting tool 110. The automated decanter 100 can include the container prepping device 120 and activate it based on need, such as the type of cut. The controller 160 can determine when to activate the container prepping device 120 via communications with the cutting tool 110.

Figure 7B:
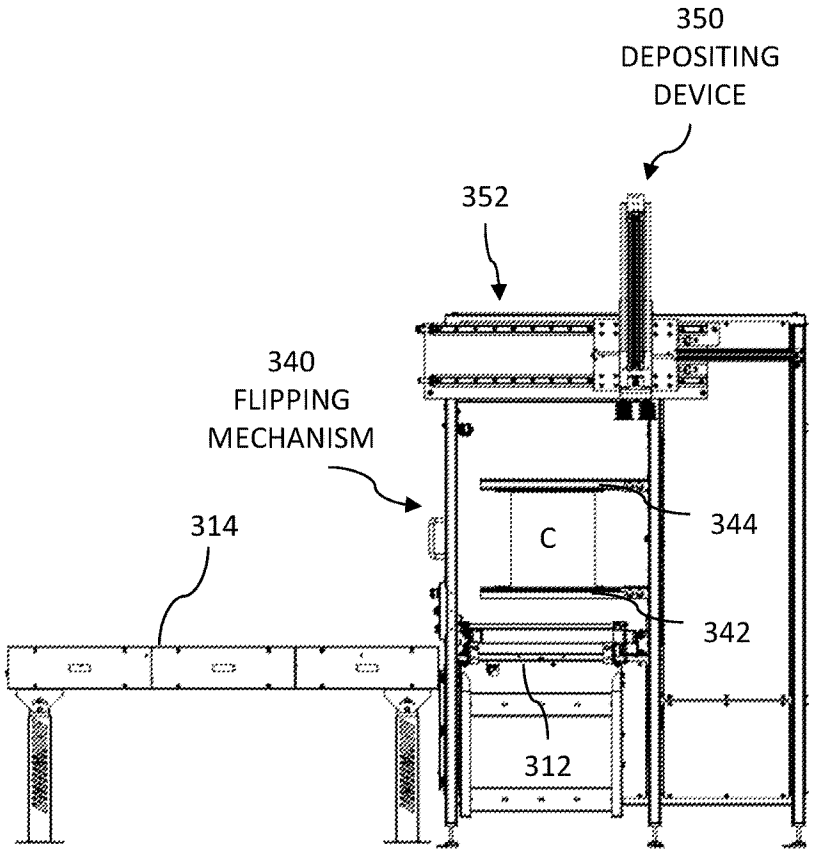
FIG. 7B illustrates a side view of the flipping mechanism of the automated decanter of FIG. 3 lifting and holding the container.
Figure 7A:
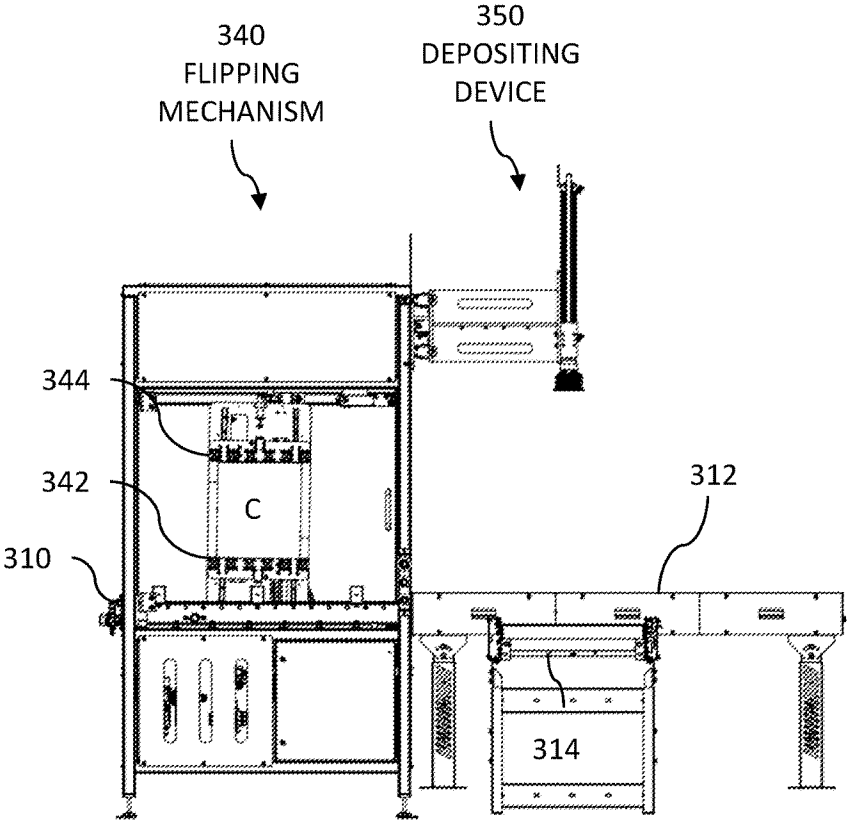
FIG. 7A illustrates a front view of the flipping mechanism of the automated decanter of FIG. 3 lifting and holding the container.
Figure 8:
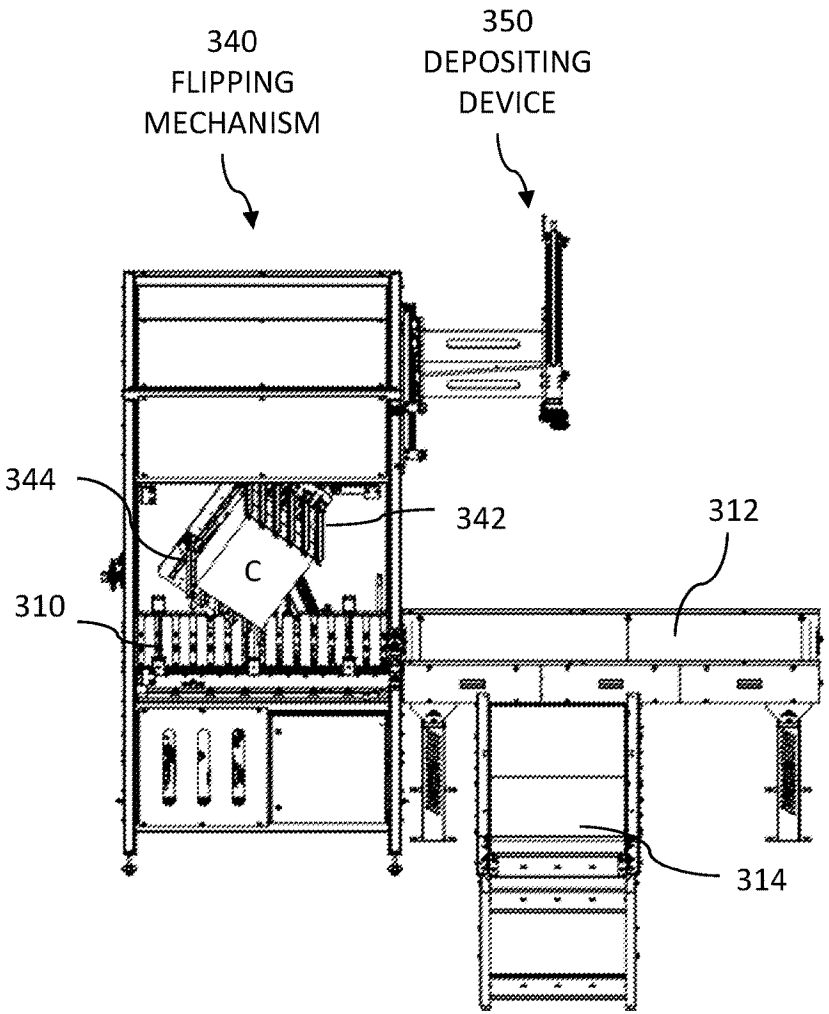
FIG. 8 illustrates a front perspective view of the flipping mechanism of the automated decanter of FIG. 3 flipping the container.

The flipping mechanism 130 is configured to rotate containers such that the top and bottom of the container are flipped. The flipping mechanism 130 can have arms that grab the container and rotate the container for the flipping. At least one of the arms can be on the top of the container to keep the product within the container when flipping. FIGS. 7A, 7B, and 8 illustrate examples of a flipping mechanism 340 that includes two arms having tines that grab a container and flip it. Instead of tines, the flipping mechanism 130 can have arms that are flat or have another configuration that allows holding and rotating a container for decanting of the products therein by the depositing device 140.

Figure 9:
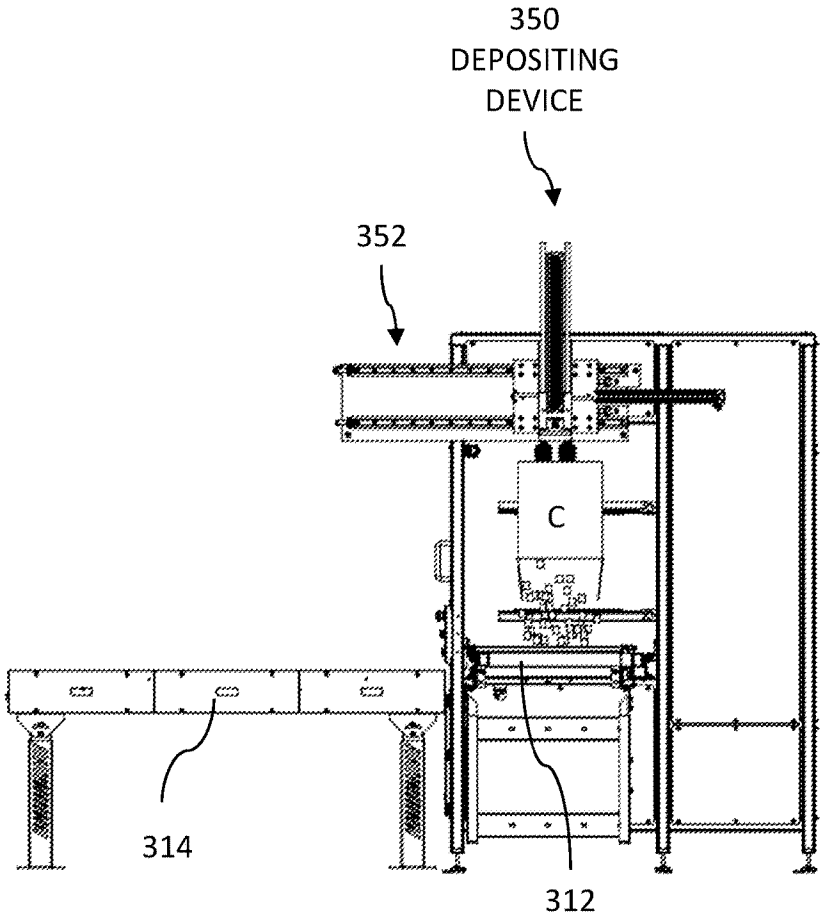
FIG. 9 illustrates a side view of the depositing device of the automated decanter of FIG. 3 lifting the container for depositing of product within the container.
Figure 10:
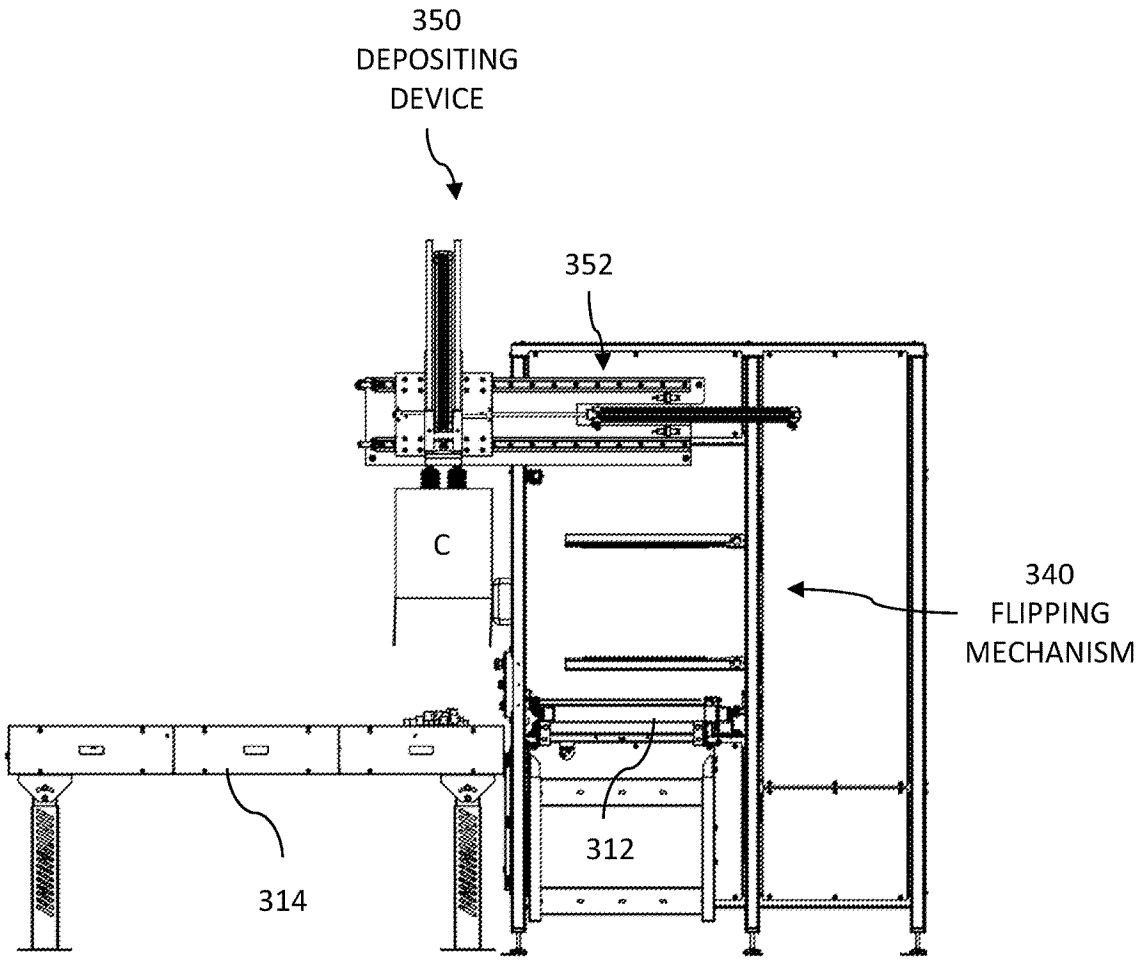
FIG. 10 illustrates a side view of the depositing device of the automated decanter of FIG. 3 depositing product within the container by sliding the container and then lifting.

The depositing device 140 is constructed to separate products from the containers by moving the container and allowing the products to fall from the containers due to gravity. The depositing device 140, a different device than the flipping mechanism 130, can lift containers from the transport system 158 and allow the products to fall back onto the transport system 158 or move the containers off of the transport system 158 to allow the products to fall on another surface. The depositing device 140 can use grippers typically used within the industry, such as pneumatic grippers, to move the containers by, for example, sliding or lifting the containers. FIGS. 9-10 illustrate examples of a depositing device 350, which use grippers to lift or slide a container for decanting. Instead of sliding, the depositing device 140 can use an arm to move containers off of the transport system 158 for decanting. For example, the arm can be used to push containers off of the transport system 158. The pushing can be performed while the grippers maintain a hold on the container.

The transport system 150 provides a surface for the containers as the containers are moved through the various stages of the automated decanter 100. As such, the transport system 150 is positioned and constructed to allow (i.e., manual system) or automatically (i.e., an automated system) move containers through the various stages of the automated decanter 100. The transport system 150 can be a single apparatus that extends through each of the different stages of the automated decanter 100. The transport system 150 can also be constructed of multiple transport systems that abut each other and extend through one or more of the different stages. For example, the cutting tool 110, prepping device 120, flipping mechanism 130, and depositing device 140 each include their own transport system 152, 154, 156, 158, that collectively form the transport system 150.

The one or more processors of the controller 160 direct the operation of the automated decanter 100 according to a series of operating instructions that correspond to one or more algorithms directed to automatically decanting products from containers. The series of operating instructions can be stored on a non-transitory computer readable medium. An example of a controller is provided in FIG. 14. The controller 160 can be, for example, a computer, a laptop, a PLC, a circuit board, or a robot controller. The controller 160 can include one or more processors, RAM, a hard drive, a monitor, display, keyboard, mouse, speakers, and a conventional operational system. As noted above, the automated decanter 100 can include more than one controller. As such, the functionality of the controller 160 can be distributed.

The automated decanter 100 can be part of a product processing system that receives containers, automatically decants the containers, and further processes products from the containers after decanting. In some examples, the controller 160 can be communicatively coupled to a central controller of the product processing system and the central controller can include logic to perform some of the functionality of the controller 160 of the automated decanter 100. The product processing system can be in a fulfillment center, such as an e-commerce fulfillment center, a warehouse, storage facility, etc. A transport system, such as an automated transport system, can connect the automated decanter 100 to a processing area for additional processing. For example, the transport system 150 can be extended or another transport system can be used to move decanted products from automated decanter 100 to the processing area for additional processing.

Figure 12:
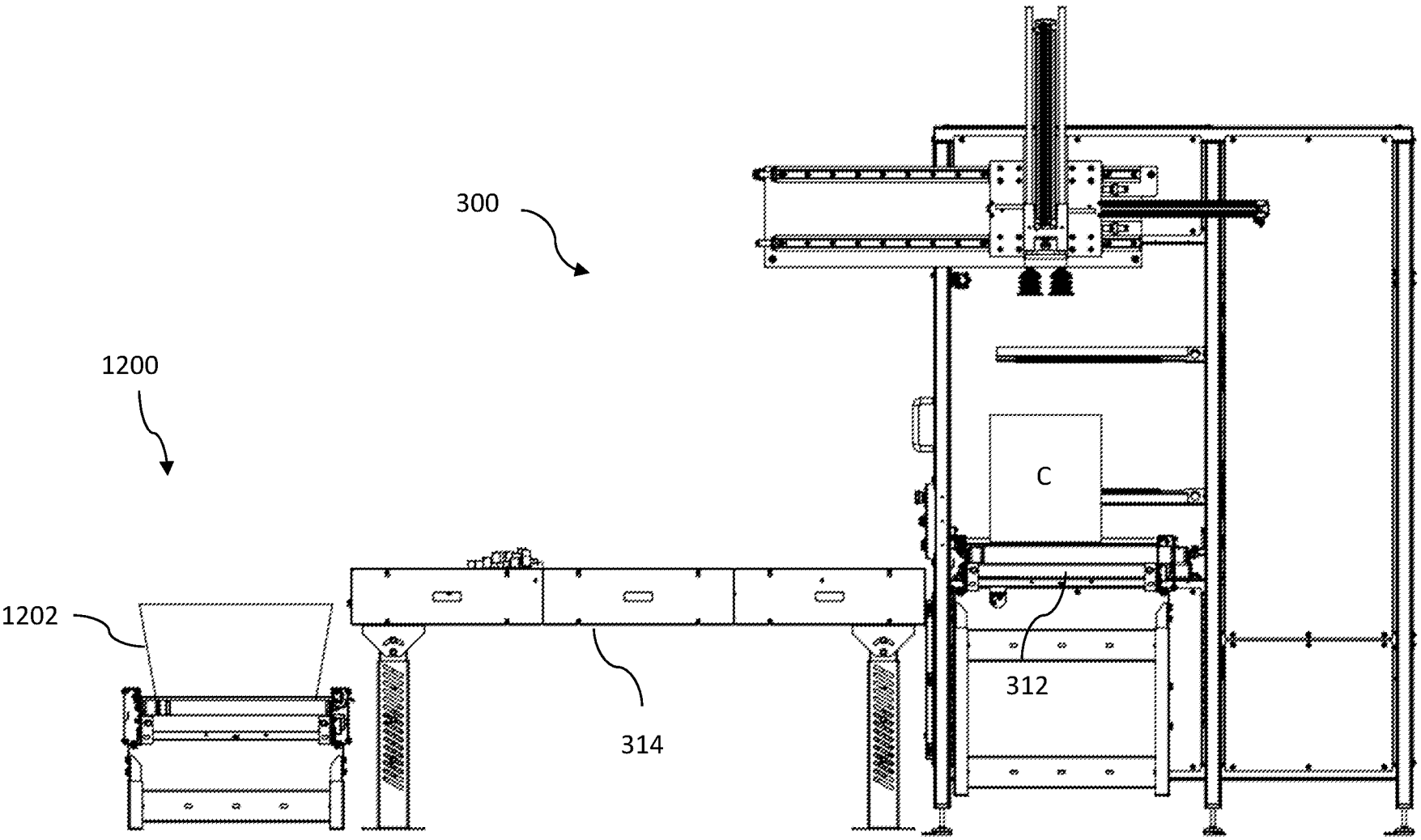
FIG. 12 illustrates an example of automatically delivering decanted product to a product processing station where the product is placed in storage containers.

The additional processing can include loading the decanted products into other containers for storing in a storage system, such as an ASRS. The original containers can be shipping containers and the containers for storage can be storage containers. The storage containers can be part of the ASRS. The product processing station can also include a quality control station or inspection station. The product processing station can also include a shipping station where the decanted products are placed in other containers for shipping. The additional processing could also include distributing the decanted products for retail, such as placing the products on shelves of a store. FIG. 12 illustrates an example of a product processing station.

Figure 2:
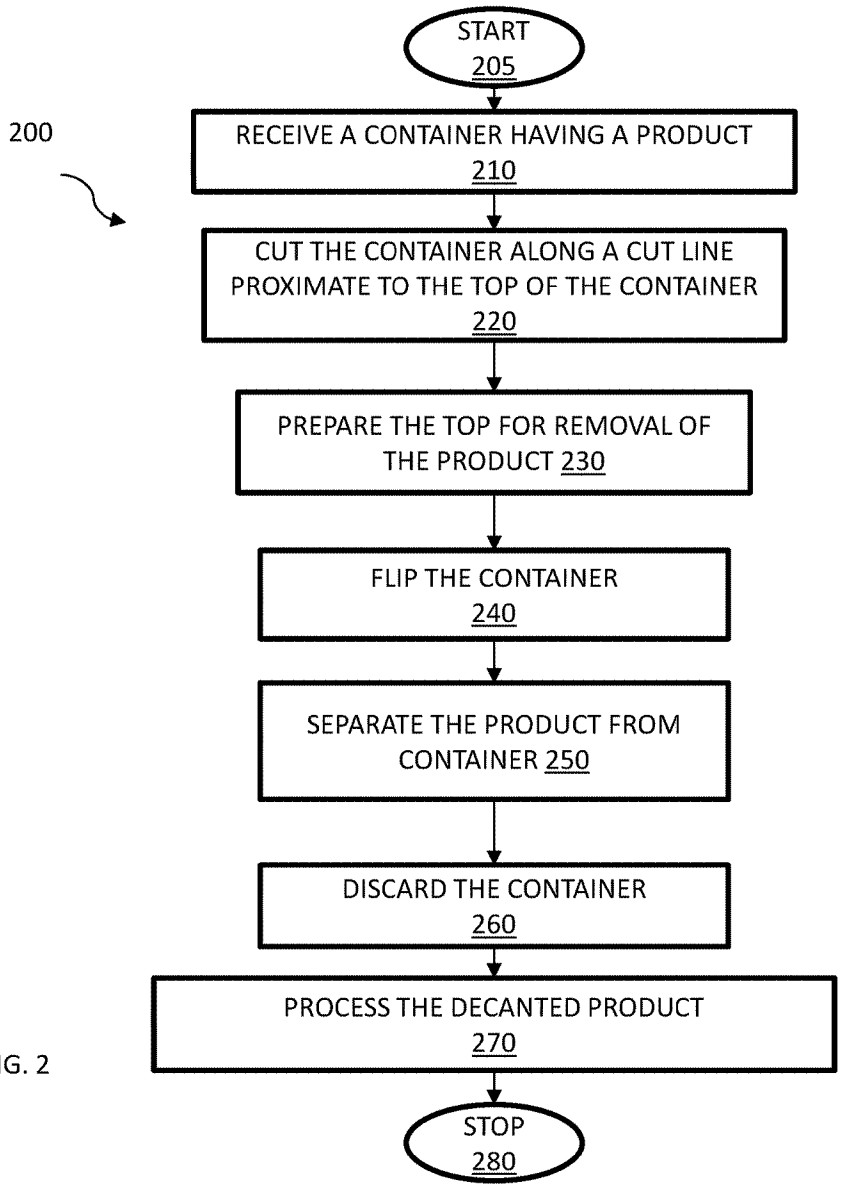
FIG. 2 illustrates a flow diagram of an example of a method of an automated decanting process carried out according to the principles of the disclosure.

FIG. 2 illustrates a flow diagram of an example of a method 200 of an automated decanting process carried out according to the principles of the disclosure. Each of the steps of the method 200 can be considered stages of the decanting process and one or more transport systems, such as an automated transport system, can move a container to each of the stages. As noted above, each of the different stages can have their own transport system and these transport systems can abut to each other. The method 200 can be repeated multiple times for multiple containers.

Figure 3:
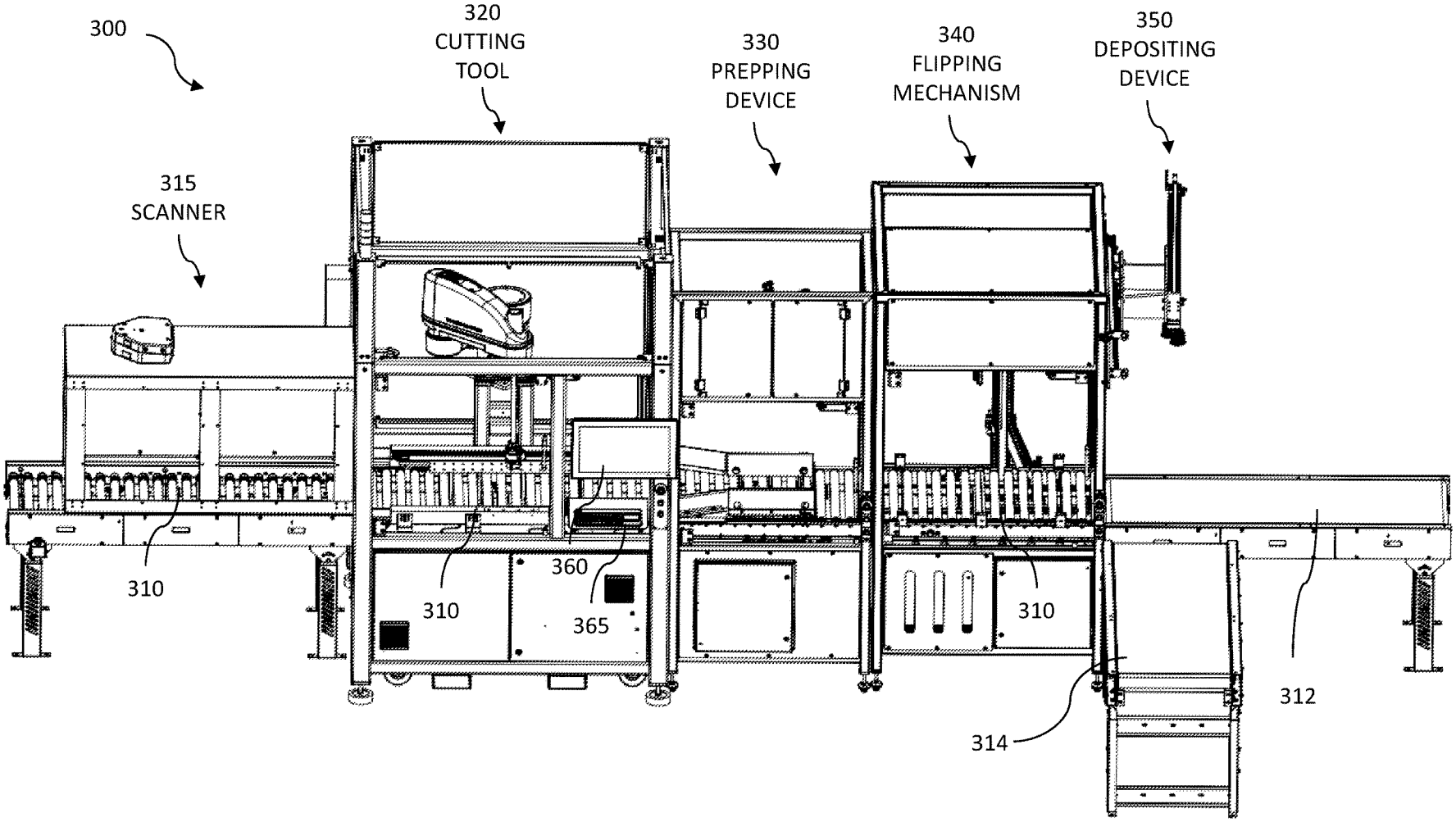
FIG. 3 illustrates a front perspective view of an example of an automated decanter constructed according to the principles of the disclosure.

At least a portion of the method 200 can be carried out using an apparatus or system, such as automated decanter 100 and automated decanter 300 represented in FIG. 3. The below discussion of the automated decanting process of method 200 refers to FIG. 3 and various portions of automated decanter 300 illustrated in FIGS. 4 to 12 as a container moves therethrough according to method 200. Automated decanter 300 includes a transport system 310, a scanner 315, a cutting tool 320, a prepping device 330, a flipping mechanism 340, and a depositing device 350. A display 360 and a keyboard 365 are also shown that are used to interface with a controller (not shown) of the automated decanter 300. Controller 160 of FIG. 1 provides an example of a controller that can be used with automated decanter 300. The transport system 310 moves containers through the different stages, or modules, of the automated decanter 300. The method 200 begins in step 205.

Figure 4:
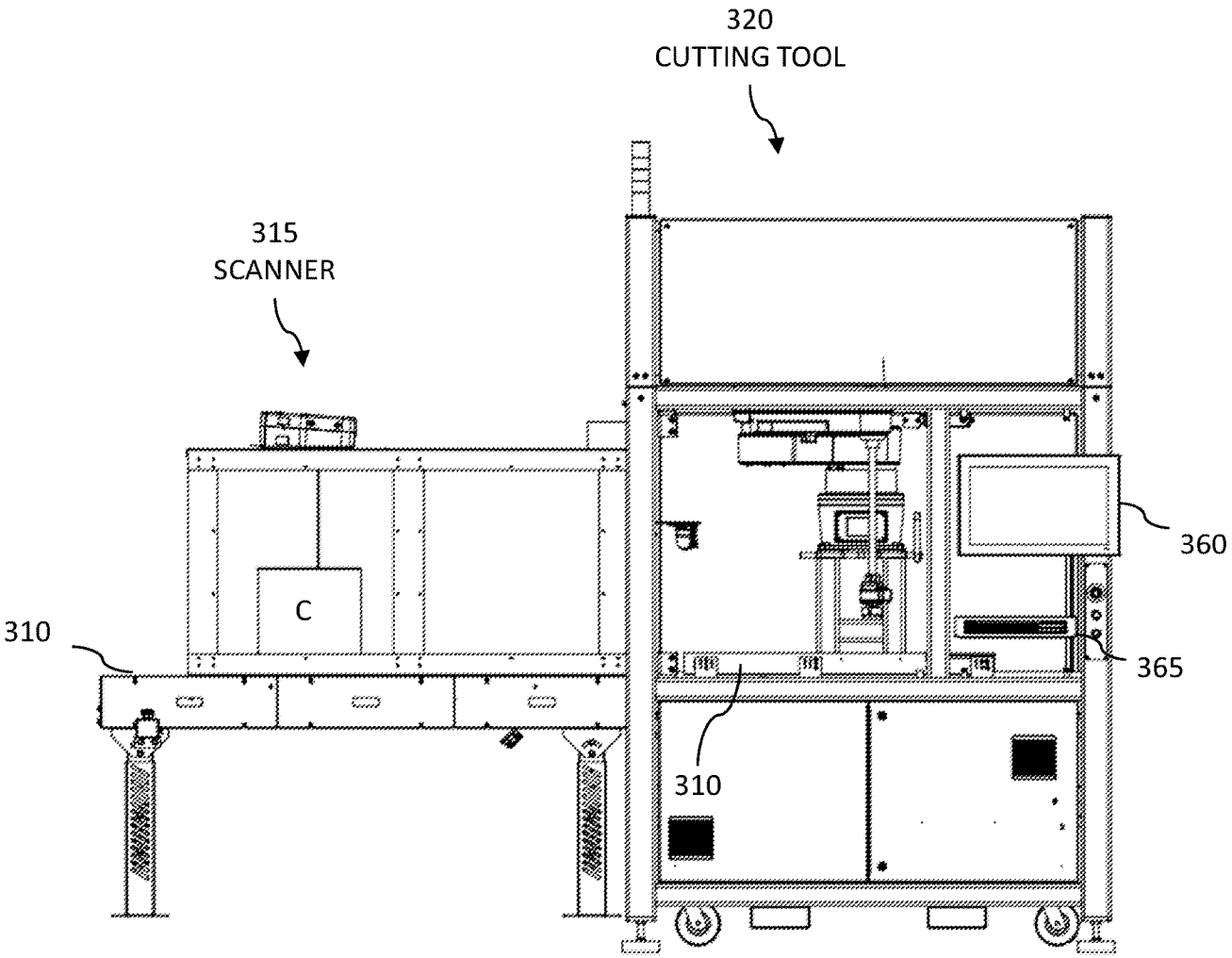
FIG. 4 illustrates a front view of the scanner and cutting tool of the automated decanter of FIG. 3, wherein a container has been received and is being scanned.

In step 210, a container having a product is received. The container can have one or more products. The container can be received via a transport system, such as a conveyor. FIG. 4 illustrates automated decanter 300 receiving a container on conveyor 310 and being scanned by scanner 315. The scanner 315 can determine information about the container that can be used for cutting the container. For example, the scanner 315 can read a bar code on the container to obtain box characteristics used to determine cutting features for cutting the container or scan the container itself to determine the container dimensions. The scanner 315 can be a conventional scanner, RFID reader, camera, or the like as is used in the art.

Figure 5:
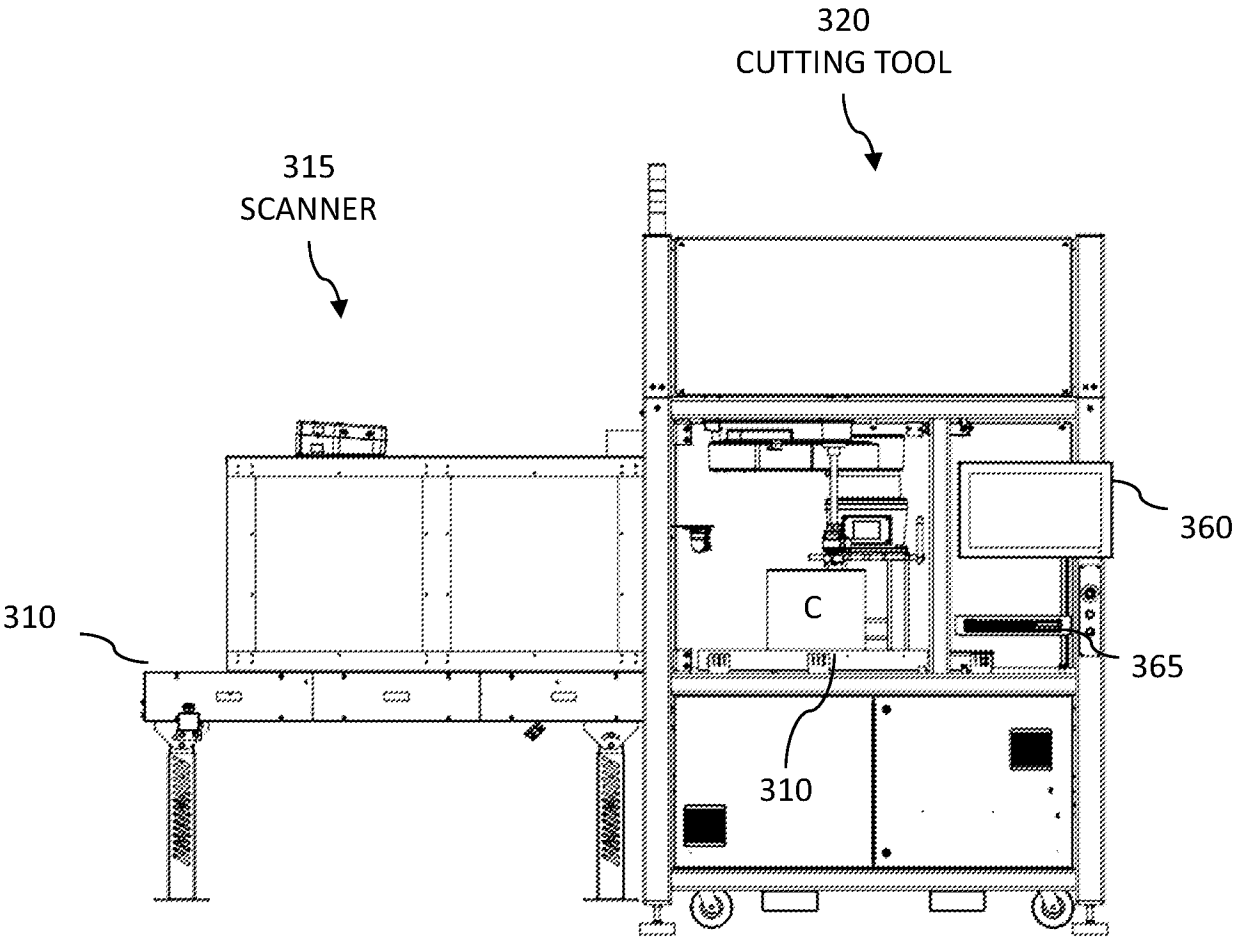
FIG. 5 illustrates a front view of the scanner and cutting tool of the automated decanter of FIG. 3, wherein the container has been moved from the scanner to the cutting tool.

In step 220, the container is cut along a cut line. The cut line is proximate the top of the container. For example, the cut line can be within a half of an inch of the top of the container or along a seam between one or more side walls and the top. The cut line can correspond to a tape line. It is appreciated that a number of cut configurations could be used in step 120, such as 3-sided cuts, 4-sided cuts, plunge cuts, and window cuts. FIG. 5 illustrates the container after the container has been moved along the conveyor 310 to the cutting tool 320. The cutting tool 320 can be an IBOD or another similar device as described above with respect to cutting tool 110. Cutting may also be performed manually.

Figure 6:
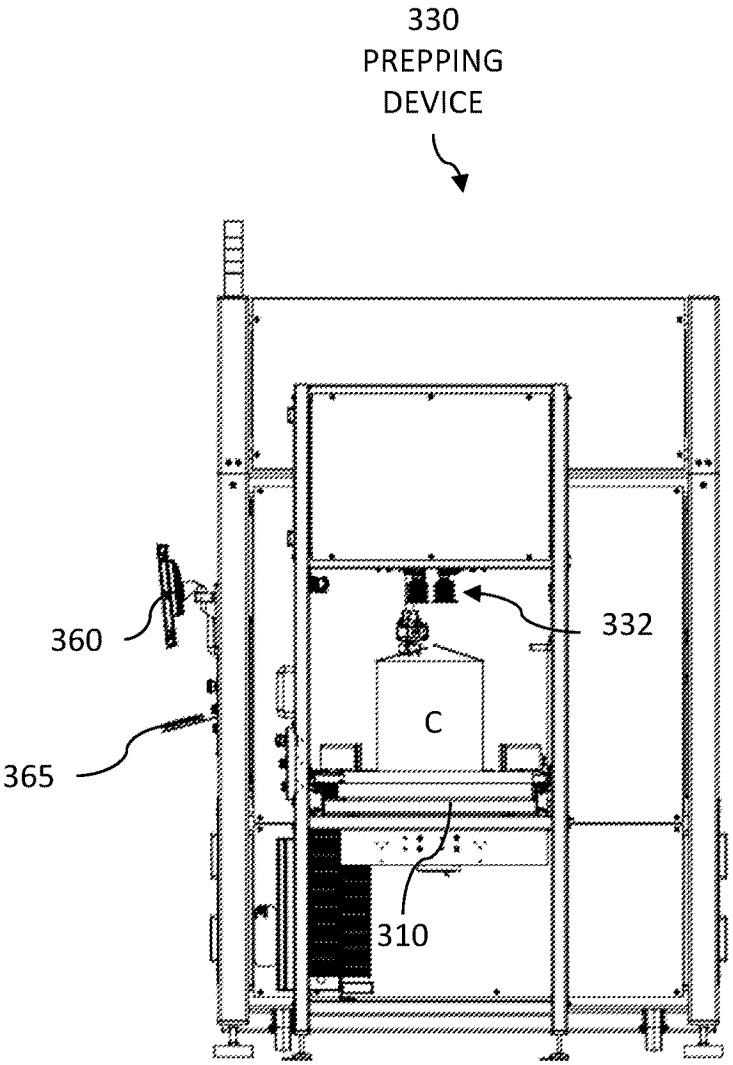
FIG. 6 illustrates a side view of the automated decanter of FIG. 3 that shows the prepping device after popping open the top of the container.

The container is prepared for removing the product in step 230. A container prepping device can lift, such as via suction, the top of the container to prepare the container for decanting. Pneumatic grippers can be used to pop the top of the container. FIG. 6 provides a visual example of prepping device 330 having grippers 332 that have grabbed the top of the container and the condition of the top of the container after being lifted-up by the grippers 332. The top of the container can be in more than one piece as illustrated. As evident in FIG. 6, cutting tool 320 used a cut line corresponding to a tape line to cut the container. When the cutting tool 320 follows a cut line along all of the sidewalls proximate the top of the container, the prepping device 330 can remove and discard the top of the container using the grippers 332. The removed top can be discarded by the prepping device 330 to a trash bin, the floor, or a transport system. When the cutting in step 220 includes cutting less than all the side walls of the container proximate the top of the container, step 230 may or may not be omitted from method 200 and method 200 can move directly to step 240 after step 220. In some instances, such as with a three-sided cut, the prepping device 330 may ensure that the cuts on the three side walls intersect such that the top will flip open when reaching the decanting stage.

In step 240, the container is flipped. A flipping mechanism can be used to rotate the container such that the top and bottom are flipped. The flipping mechanism can have arms that grab the container and rotate the container for the flipping. At least one of the arms can be on the top of the container to keep the product within the container when flipping. FIGS. 7A and 7B illustrate different views of the flipping mechanism 340 lifting the container after the container has been moved via the transport system 310. The flipping mechanism 340 includes two arms 342 and 344, having tines that grab the container and flip it. The tines of the bottom arm 342 (bottom tines) fit between rollers of the transport system 310 and are raised when the container is in position to be flipped. Instead of tines, the arms 342 and 344, can be flat or have another configuration that allows holding and rotating the container. FIG. 8 shows an example of the arms 342 and 344, rotating the container such that the top of the container will be placed on the transport system 310 and will be ready for decanting.

The product is separated from the container in step 250. The product can be separated by moving the container, such as lifting the container or sliding the container over a second surface that is different than the surface, a first surface, upon which the flipped container is positioned. The second surface can be lower than the first surface. A depositing device can be used to separate the product from the container. Depositing device 350 is shown in FIG. 9 lifting the container such that the product is deposited on transport system 312. The transport system 312 abuts with the transport system 310. The depositing device 350 includes grippers that lift the container. The grippers can be pneumatically operated.

In FIG. 10, the depositing device 350 has slid the container from transport system 312 to transport system 314 to release the product from the container. The depositing device 350 can grip the container using grippers and slide the container along a track 352. Since the height of transport system 312 is greater than the height of transport system 314, the product falls from the container after being slid. In FIG. 10, the depositing device 350 has lifted the container after sliding the container. Instead of another transport system, the depositing device 350 can slide the container over another surface or one or more other containers for releasing the product. The decanted product from either of the examples of FIGS. 9 and 10 can then be transported (manually or automatically) to a product processing station. FIG. 12 illustrates an example of transporting product to a product processing station based on the depositing device of FIG. 10.

Figure 11:
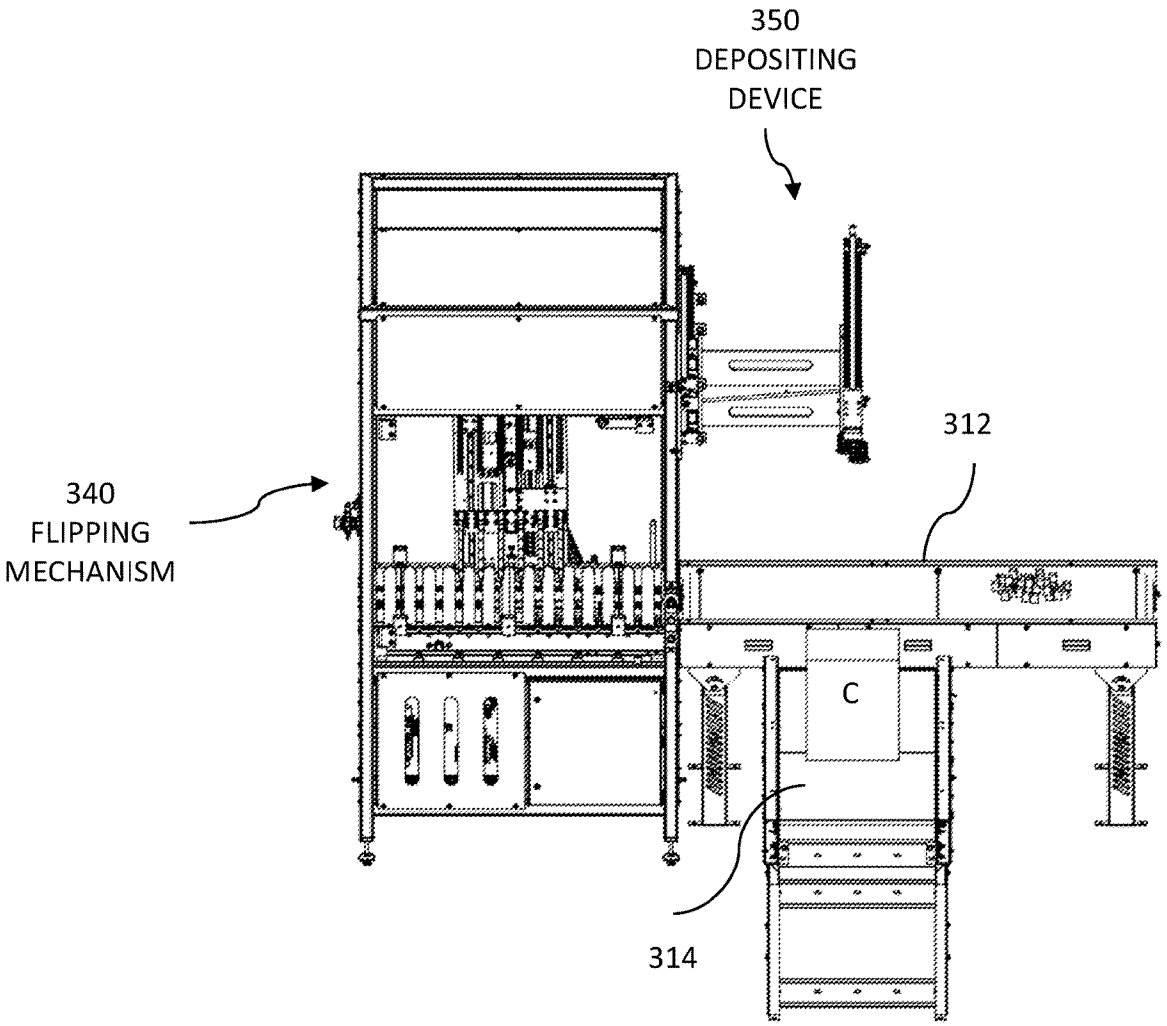
FIG. 11 illustrates a front view of an example of discarding the container, using the depositing device, on a transport system that is different than the transport system upon which the products were released.

The container is discarded in step 260. The container can be discarded by the depositing device. The container can be discarded on another surface for removal. One skilled in the art appreciates that the discarded container could be placed on the same location or transport system as the product separated from the container. FIG. 11 illustrates an example of discarding the container using the depositing device 350 on another transport system, transport system 314, that is different than the transport system upon which the products were released, transport system 312, according to the example of FIG. 9. Similarly, using the example of FIG. 10, the container can be deposited on transport system 312. The depositing device 350 can also discard the container on the floor, within a trash bin, or even on the transport system upon which the product is released for removal.

Method 200 continues to step 270 where the decanted product is further processed. For example, the decanted product can be manually or automatically delivered to a product processing station. FIG. 12 shows an example of automatically delivering decanted product to a product processing station 1200 where the product is placed in storage containers represented by storage container 1202. The storage containers can be part of an ASRS. In the example the product processing station 1200, the transport system 314 automatically delivers decanted product to the product processing station 1200. Method 200 continues to step 280 and ends. As noted above, method 200 can be repeated multiple times for various containers.

Figure 13:
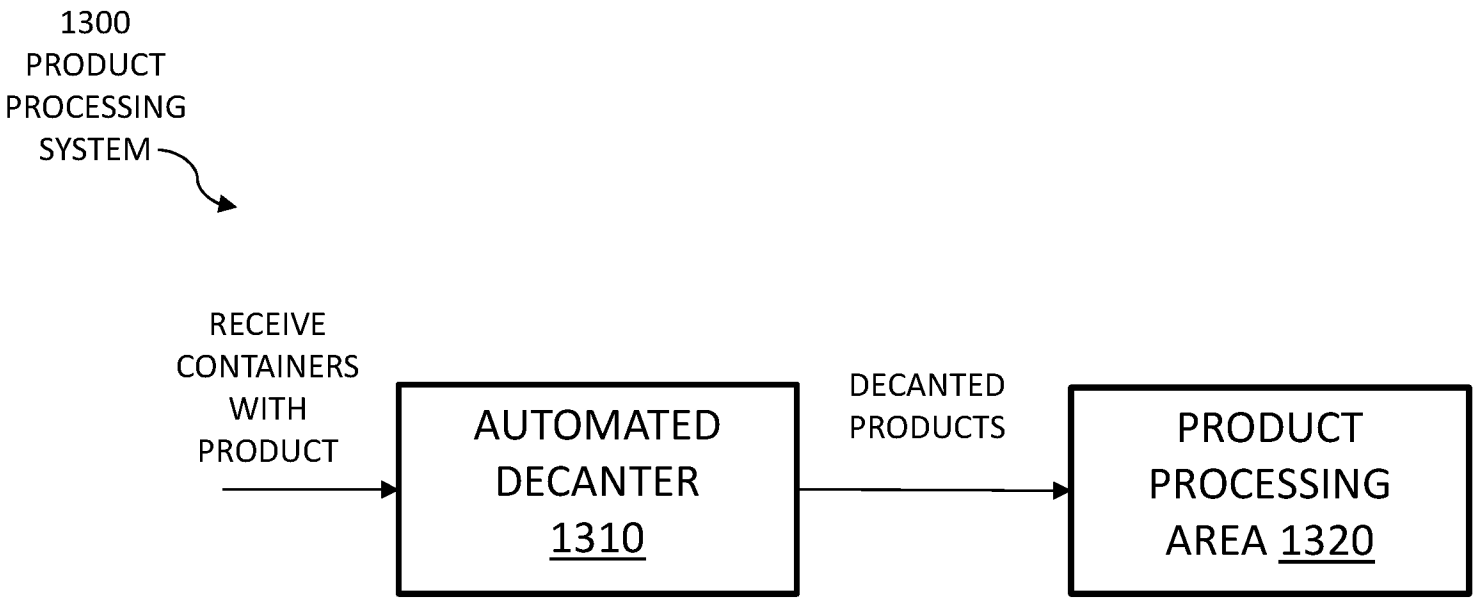
FIG. 13 illustrates a product processing system for receiving, decanting, and processing containers having products according to the principles of the disclosure.

FIG. 13 illustrates a product processing system 1300 for receiving, decanting, and processing containers having products according to the principles of the disclosure. The product processing system 1300 includes an automated decanter 1310 and at least one product processing station 1320. The automated decanter 1310 can be, for example, automated decanter 100 or 300 as disclosed herein. The product processing station 320 can be the product processing station 360. The product processing station 360 can include, for example, one or more shipping stations, one or more storage systems, and/or one or more quality control stations. In some examples, decanted products from the automated decanter 1310 can be automatically decanted into storage containers, such as storage containers 362, for an ASRS. The automated decanter 1310 and the product processing station 1320 can be connected via a transport system, such as an automated conveyor.

Figure 14:
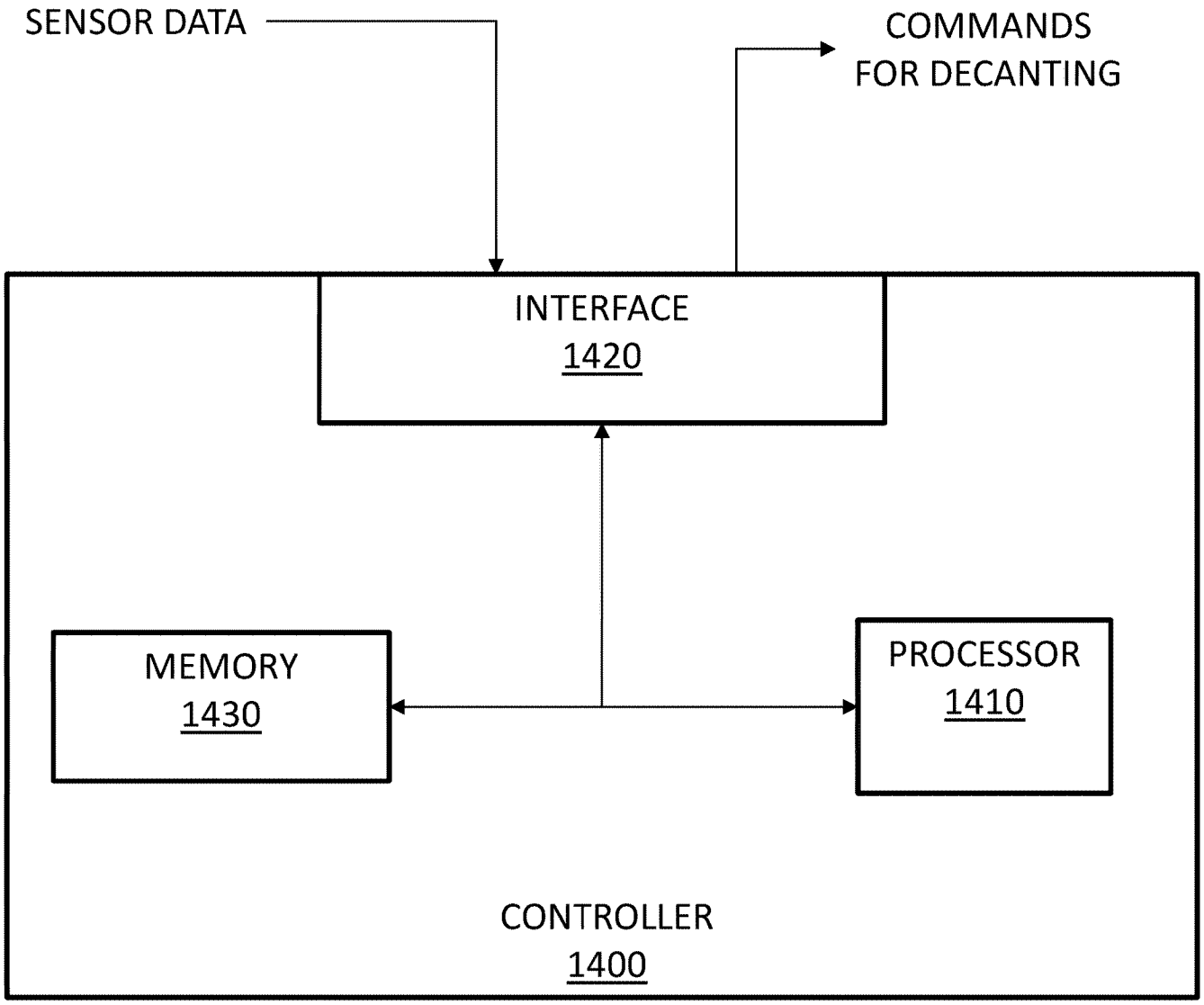
FIG. 14 illustrates a block diagram of an example of a controller constructed according to the principals of the disclosure.

FIG. 14 illustrates a block diagram of an example of a controller 1400 constructed according to the principals of the disclosure. The controller 1400 includes one or more processors, represented by processor 1410, which are configured to direct the operation of an automated decanter or decanting system. The processor 1410 may be a conventional processor such as a microprocessor. Additionally, the controller 1400 includes an interface 1420 and a memory 1430 coupled thereto. The components of the controller 1400 can be coupled together by and communicate via typical means used in the industry, such as conventional connections and communication protocols. One skilled in the art will understand that the controller 1400 can include additional components typically included with a controller such as a power supply or power port.

The interface 1420 includes multiple ports for transmitting commands and receiving data from at least the sensors of the automated decanter, such as from the sensors/positioners 170 of FIG. 1. The interface 1420 can support wireless or wired communications. Additionally, the interface 1420 can receive programming to direct the operation of the automated decanter. The programming instructions can be code representing algorithms that, for example, correspond to the method 200. The commands can direct an automated transport system to move containers to different stages of an automated decanting process and control the stages. The stages correspond to, for example, the cutting tool 110, the prepping mechanism 120, the flipping device 130, and the depositing device 140, and to one or more of the steps of method 200. For example, the commands can be in response to received sensor data that indicates a container is in position to be cut and then when the cut container is ready to be flipped. Sensor data can also indicate when to separate the product from the container and when to discard the container. The sensor data can be received from, for example, the sensors/positioners 170 of FIG. 1. The programming instructions can be encrypted for security and stored on the memory 1430.

The memory 1430 is constructed to store data and computer programs. The memory 1430 can be a conventional memory. The memory 1430 may be a non-transitory computer readable medium store operating instructions, such as the programming instructions, to direct the operation of the processor 1410 when initiated thereby. The operating instructions may correspond to algorithms that provide the functionality of the operating schemes disclosed herein. The memory 1430, therefore, stores the programming instructions that direct the operation of an automated decanter, such as disclosed herein. The processor 1410 can also generate the commands to work with other components of a product processing system.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), programmable logic controllers, industrial Computer Processors, or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Configured or configured to means, for example, designed, constructed, or programmed, with the necessary logic and/or features for performing a task or tasks. A configured device, therefore, is capable of performing the task or tasks. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, because the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein. The below independent claims can include one or more of the features of the dependent claims in combination.

What is claimed is:

1. An automated decanter, comprising:

a cutting tool configured to cut a container along a cut line, wherein the container has a bottom, a top, and multiple side walls between the bottom and the top, and the cut line is proximate the top;

a flipping mechanism configured to flip the container upside down after the cut, wherein the bottom of the container is directly contacting a surface for the cut and the flipping mechanism flips the container wherein the top is directly contacting the surface after the cut; and a depositing device configured to, after the container is flipped upside down, separate one or more products within the container from the container, wherein both the top and the bottom remain attached to the container during the flip.

2. The automated decanter as recited in claim 1, wherein the flipping mechanism includes an arm to keep the one or more products within the container during the flip.

3. The automated decanter as recited in claim 1, wherein the surface is a surface of a conveyor and the cutting tool, the flipping mechanism, and the depositing device are sequential sections along the conveyor.

4. The automated decanter as recited in claim 3, wherein the surface of the conveyor is a first surface and the one or more products are deposited on a second surface after being separated from the container.

5. The automated decanter as recited in claim 4, wherein the first surface is at a first height and the second surface is at a second height that is different than the first height.

6. The automated decanter as recited in claim 4, wherein the conveyor is a first conveyor and the second surface is a surface of a second conveyor that is different than the first conveyor.

7. The automated decanter as recited in claim 4, wherein the container is a first container and the second surface includes a second container that receives the one or more products after being separated from the first container.

8. The automated decanter as recited in claim 1, wherein the one or more products are deposited on the surface after being separated from the container.

9. The automated decanter as recited in claim 1, wherein the depositing device is configured to separate the one or more products from the container by moving the container.

10. The automated decanter as recited in claim 9, wherein the moving includes lifting the container to separate the one or more products from the container.

11. The automated decanter as recited in claim 9, wherein the moving includes sliding the container to separate the one or more products from the container.

12. The automated decanter as recited in claim 1, wherein the cut line is along a tape line on the top.

13. The automated decanter as recited in claim 1, wherein the cut line is along each of the multiple side walls.

14. The automated decanter as recited in claim 1, further comprising a container prepping device that is configured to prepare the attached top for removing the one or more products from the container after the cut and before the flip.

15. The automated decanter as recited in claim 14, wherein the depositing device is further configured to discard the container after the one or more products are separated from the container.

16. A product processing system, comprising:

an automated transport system having a conveyor; and an automated decanter that receives containers from the automated transport system via the conveyor and includes:

a flipping mechanism configured to flip the containers after being cut along a cut line, wherein bottoms of the containers are directly contacting a surface of the conveyor for the cut and the flipping mechanism flips the containers wherein tops of the containers are directly contacting the surface after the cut, and all sides of the containers remain attached to the containers during the flip; and a depositing device configured to, after the containers are flipped, separate one or more products within the containers from the containers.

17. The product processing system as recited in claim 16, wherein the automated transport system is further configured to deliver the one or more products to one or more quality control stations.

18. The product processing system as recited in claim 16, wherein the automated transport system is further configured to deliver the one or more products to an automated storage and retrieval system.

19. The product processing system as recited in claim 16, wherein the depositing device is a different device than the flipping device.

20. A method of automatically decanting products, comprising:

cutting a container having product along a cut line proximate a top side of the container, wherein the container also has a bottom side and multiple side walls, and the bottom side of the container directly contacts a surface for the cut;

rotating the container after the cutting, wherein the top side of the container directly contacts the surface after the cut and the product remains in the container during the rotating; and separating the product from the container by moving the container, wherein both the top and the bottom remain attached to the container during the separating.

21. The method as recited in claim 20, further comprising preparing the top of the container for the separating by lifting the attached top of the container after the cutting and before the rotating.

22. The method as recited in claim 20, wherein the rotating is one hundred and eighty degrees.

* * * * *